US007000504B2

(12) United States Patent
Chen

(10) Patent No.: US 7,000,504 B2
(45) Date of Patent: Feb. 21, 2006

(54) RATCHET WRENCH HAVING SIMPLIFIED ADAPTER

(76) Inventor: Hsin Nien Chen, No. 10, Lane 143, Sec. 1, Hsin Shen South Road, Taipei (TW) 106

( * ) Notice: Subject to any disclaimer, the term of this patent is extended or adjusted under 35 U.S.C. 154(b) by 15 days.

(21) Appl. No.: 10/835,993

(22) Filed: Apr. 29, 2004

(65) Prior Publication Data

US 2005/0241443 A1 Nov. 3, 2005

(51) Int. Cl.
*B25B 13/46* (2006.01)

(52) U.S. Cl. ..... 81/60; 81/63.2

(58) Field of Classification Search ..... 81/60–63.2, 81/180.1, 185

See application file for complete search history.

(56) References Cited

U.S. PATENT DOCUMENTS

| | | | | |
|---|---|---|---|---|
| 5,901,620 | A * | 5/1999 | Arnold | 81/63.2 |
| 6,257,096 | B1 * | 7/2001 | Ling | 81/60 |
| 6,601,476 | B1 | 8/2003 | Hu | 81/60 |
| 6,647,831 | B1 * | 11/2003 | Hu | 81/60 |
| 6,845,691 | B1 * | 1/2005 | Hsien | 81/60 |
| 6,868,758 | B1 * | 3/2005 | Chen | 81/60 |

* cited by examiner

*Primary Examiner*—David B. Thomas
(74) *Attorney, Agent, or Firm*—Charles E. Baxley

(57) ABSTRACT

A ratchet wrench includes a handle having a head, a hollow ratchet wheel rotatably received in the head and controlled by a control device, and a tool member engageable with a lower portion of the hollow ratchet wheel and having a stem engageable through the hollow ratchet wheel. A resilient and deformable ring member is attached onto the stem, and engageable through the ratchet wheel, and engageable with an upper portion of the hollow ratchet wheel, to quickly anchor the tool member to the hollow ratchet wheel with the ring member, and to prevent the tool members from being disengaged from the hollow ratchet wheel.

2 Claims, 6 Drawing Sheets

RATCHET WRENCH HAVING SIMPLIFIED ADAPTER

The present invention relates to U.S. patent application Ser. No. 10/083,434, filed 27 Feb. 2002, now U.S. Pat. No. 6,748,824, issued 15 Jun. 2004.

BACKGROUND OF THE INVENTION

1. Field of the Invention

The present invention relates to a ratchet wrench, and more particularly to a ratchet wrench having an easily anchoring structure or device or having a simplified tool adapter, for easily attaching or attaching various tool members to the ratchet wrenches.

2. Description of the Prior Art

Various kinds of typical ratchet wrenches have been developed for engaging with and for driving fasteners, and comprise a ratchet mechanism for easily rotating or driving the fasteners.

In order to engage with and to drive the fasteners, a number of sockets are required to be selectively and changeably attached to the ratchet wrenches, for selectively engaging with various fasteners or tool extensions.

However, the sockets may not be directly attached to the ratchet wrenches, and an additional tool adapter is required to be attached to the ratchet wrenches, to engage with and to attach or to couple the sockets to the ratchet wrenches.

For example, U.S. Pat. No. 6,57,096 to Ling discloses one of the typical ratchet wrenches comprising a hollow ratchet wheel rotatably mounted in a box end of a spanner, and a socket adapter includes a mediate section releasably engaged with the hollow ratchet wheel, and a distal socket engaging portion extended beyond the hollow ratchet wheel for engaging with and for rotating or driving the fasteners.

In order to retain or anchor the sockets to the distal socket engaging portion of the socket adapter, a spring biased pin and a ball are further required to be attached to the socket adapter, to releasably or detachably attaching the sockets to the socket adapter, such that the typical socket adapters for the typical ratchet wrenches are complicated and may not be easily manufactured or assembled.

U.S. Pat. No. 6,601,476 to Hu discloses another typical ratchet wrench comprising a similar hollow ratchet wheel, a socket adapter releasably attached to the hollow ratchet wheel, for engaging with and for rotating or driving the fasteners, and a spring biased pin and a ball attached to the socket adapter.

In order to retain or anchor the socket adapter to the socket wrench, a retainer having a resilient retaining section is required to be secured onto the socket adapter, to engage with and to attach the socket adapter to the typical ratchet wrenches.

However, the resilient retaining section of the retainer includes a complicated configuration that should be made of steel or metal materials, and that may not be easily manufactured. In addition, the retainer should be forced through the hollow ratchet wheel, and may have a good chance to scrape and damage the teeth of the hollow ratchet wheel of the typical ratchet wrenches.

The present invention has arisen to mitigate and/or obviate the afore-described disadvantages of the conventional ratchet wrenches.

SUMMARY OF THE INVENTION

The primary objective of the present invention is to provide a ratchet wrench including an easily anchoring structure or device, or having a simplified tool adapter, for easily attaching various tool members to the ratchet wrenches and for allowing the tool members to be effectively rotated or driven by the ratchet wrenches.

In accordance with one aspect of the invention, there is provided a ratchet wrench comprising a handle including a head having a compartment formed therein, a hollow ratchet wheel rotatably received in the compartment of the handle, the hollow ratchet wheel including an upper portion and a lower portion, and including a space formed therein, a driving direction control device received in the handle, and engaged with the hollow ratchet wheel, to control driving direction of the hollow ratchet wheel, a tool member including a body engageable with the lower portion of the hollow ratchet wheel, and including a stem extended upwardly from the body and engageable through the space of the hollow ratchet wheel and rotated in concert with the hollow ratchet wheel, and a resilient and deformable ring member attached onto the stem, and engageable through the space of the hollow ratchet wheel, and engageable with the upper portion of the hollow ratchet wheel, to quickly attach and anchor the tool member to the hollow ratchet wheel with the ring member. The body of the tool members may be engaged with the lower portion of the hollow ratchet wheel, and the resilient ring member may be engaged with the upper portion of the hollow ratchet wheel, such that the tool member may be quickly and stably anchored or attached or retained to the hollow ratchet wheel, and may be prevented from being disengaged from the hollow ratchet wheel.

The body of the tool member includes an engaging hole formed therein for fastener receiving purposes. The tool member includes a passage formed in the stem and communicating with the engaging hole of the body, for receiving bolts or the like.

The tool member includes a peripheral groove formed therein to receiving the resilient ring member. The resilient ring member may be a rubber ring member, or a synthetic ring member, or the like.

The tool member may include a driving shank extended from the body, for fastener driving purposes. The driving shank includes a Phillips head, or includes a flat head, or includes a star-drive head, or includes a hexagonal head, or the like, extended therefrom for engaging with and for driving various fasteners or the like.

The handle includes an opening formed therein, the hollow ratchet wheel includes a plurality of teeth provided on outer peripheral portion thereof, the driving direction control device includes a pawl pivotally received in the opening of the handle and having two end teeth, and means for actuating either of the end teeth of the pawl to engage with the teeth of the hollow ratchet wheel, to control driving direction of the hollow ratchet wheel. The driving direction control device includes a rod received and secured in the opening of the handle, and engaged with the pawl, to pivotally attach the pawl to the handle, and to allow the pawl to be rotated relative to the handle about the rod.

The body of the tool member includes an outer diameter greater than, or equals to that of the stem of the tool member. The upper portion of the hollow ratchet wheel includes an inclined surface formed therein to seat the resilient ring member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
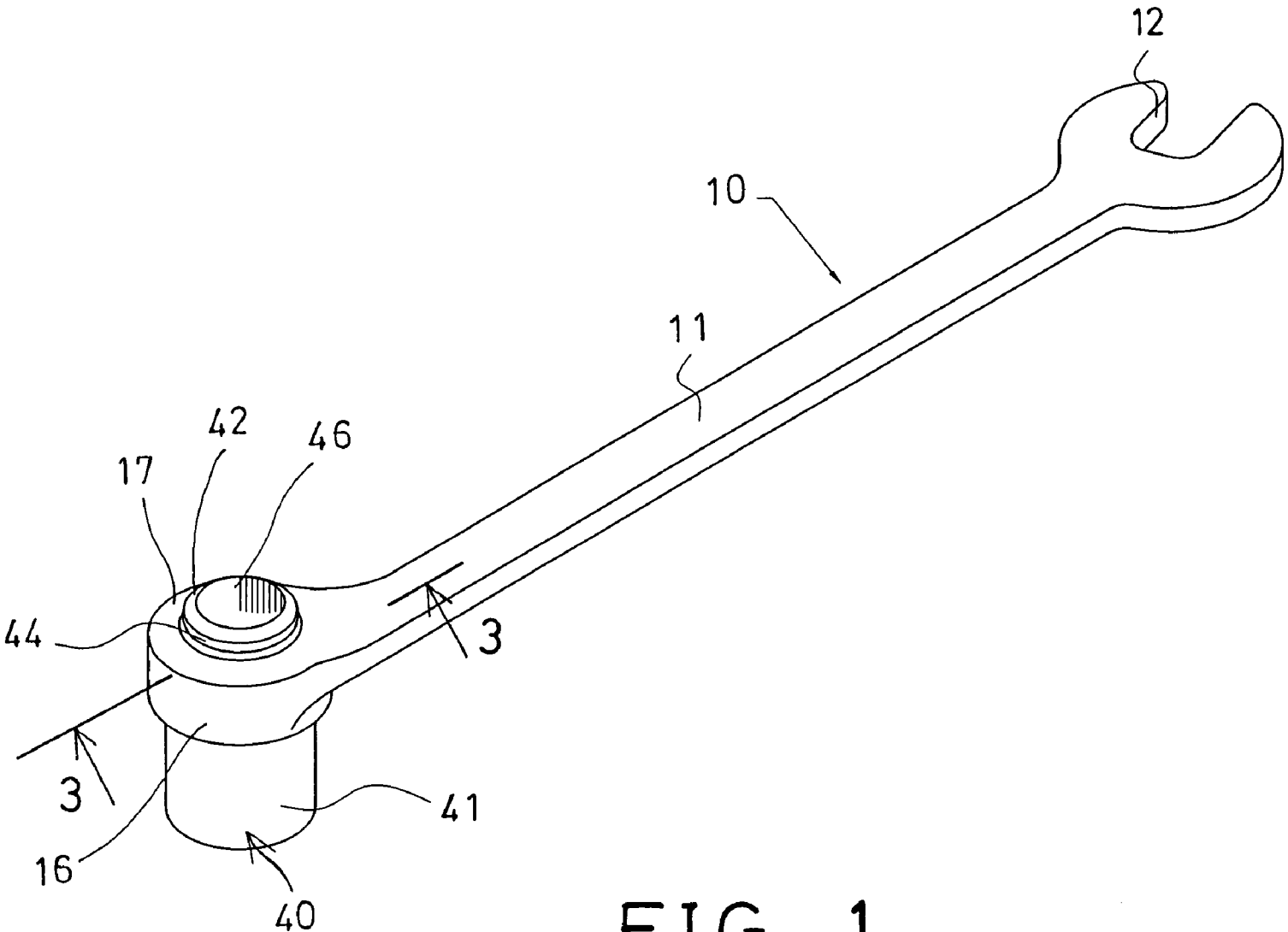
FIG. 1 is a perspective view of a ratchet wrench in accordance with the present invention.
Figure 2:
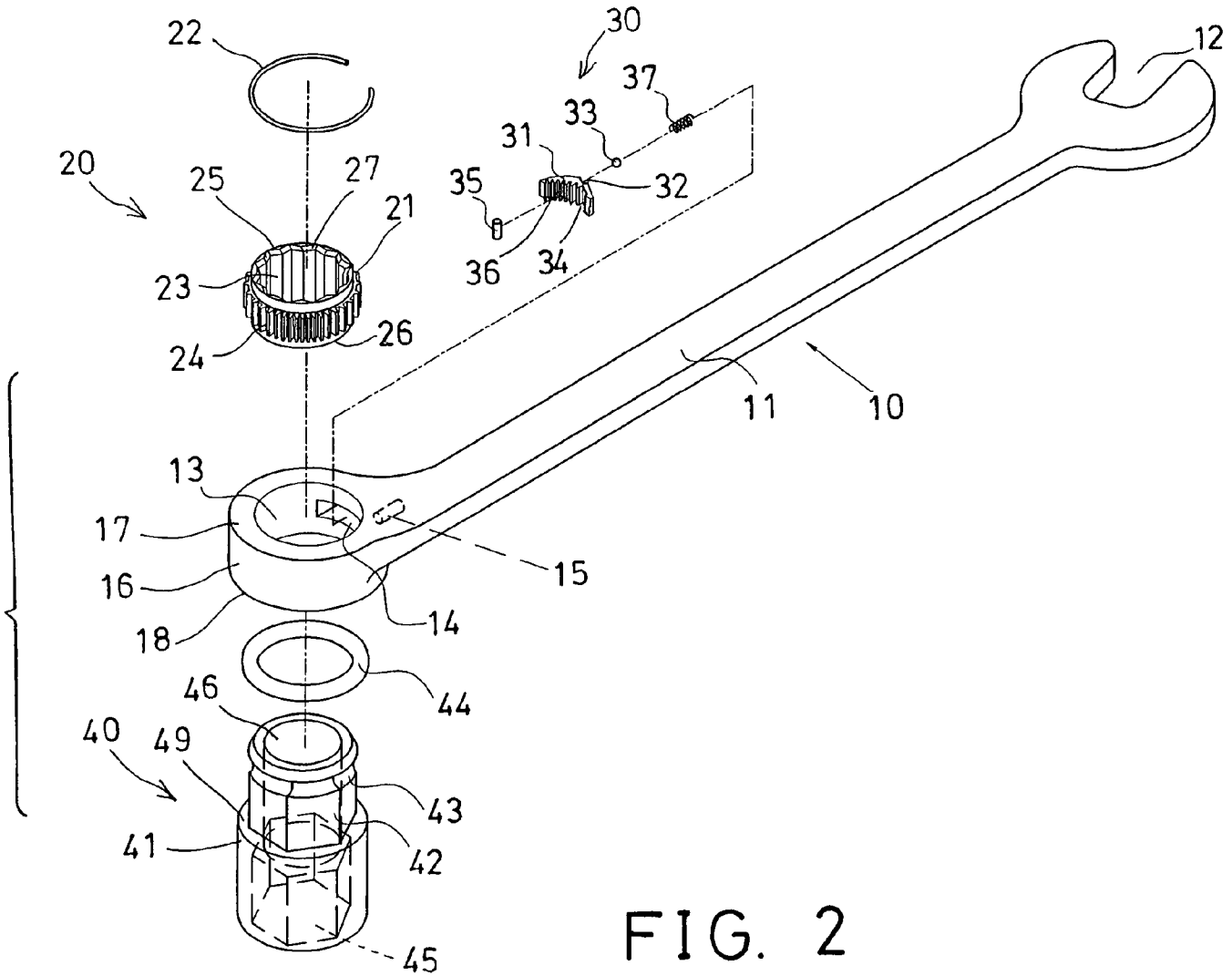
FIG. 2 is an exploded view of the ratchet wrench.
Figure 3:
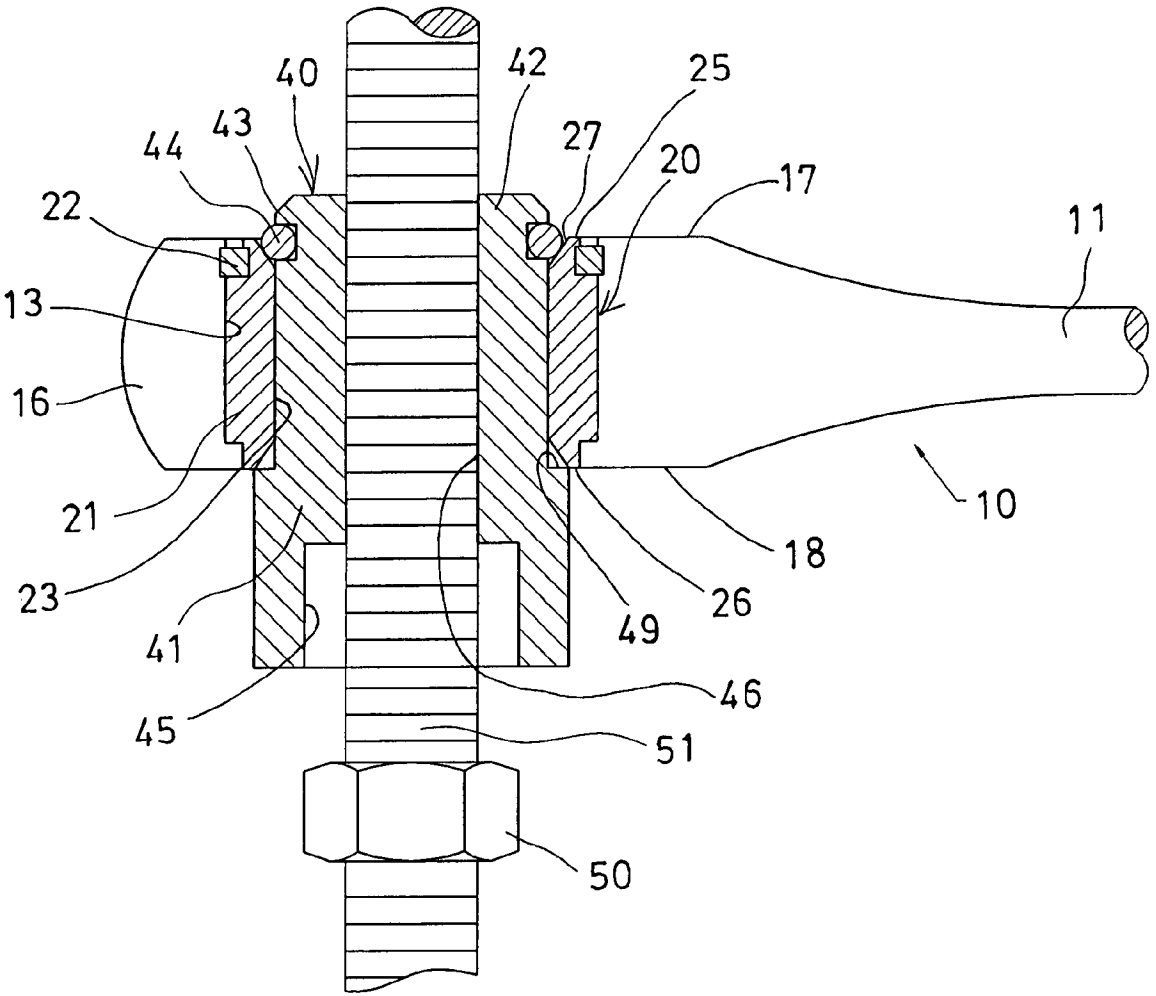
FIG. 3 is a partial cross sectional view taken along lines 3—3 of FIG. 1.

Referring to the drawings, and initially to FIGS. 1–3, a ratchet wrench 10 in accordance with the present invention comprises a handle 11 including a notch 12 formed in one end thereof for engaging with sockets, fasteners, tool extensions (not shown) or the like, and a compartment 13 and an opening 14 and a cavity 15 formed in the other end or formed in a head 16 thereof and communicating with each other.

A ratchet device 20 includes a hollow ratchet wheel 21 rotatably mounted in the compartment 13 of the handle 11 and rotatably secured to the handle 11 with a retaining ring 22, and having a space 23 formed therein for receiving tool members 40, and having a number of teeth 24 formed or provided on the outer peripheral portion thereof.

The hollow ratchet wheel 21 includes an upper surface or portion 25 preferably aligned with or flush with an upper portion or surface 17 of the head 16 of the handle 11, and a lower surface or portion 26 preferably aligned with or flush with a lower portion or surface 18 of the head 16 of the handle 11, and includes an inclined surface 27 formed in the inner peripheral portion of the upper portion 25 thereof.

A driving direction control device 30 includes a pawl 31 received in the opening 14 of the handle 11, and having a recess 32 formed in the outer portion thereof for receiving a ball or projection 33, and having a depression 34 formed in the inner portion thereof for receiving a rod 35 which may be secured or force-fitted within the opening 14 of the handle 11, to pivotally attach the pawl 31 to the handle 11, and to allow the pawl 31 to be rotated relative to the handle 11 about the rod 35.

The pawl 31 includes a number of teeth 36 formed in the inner portion thereof or formed in two ends thereof, for selectively engaging with the teeth 24 of the hollow ratchet wheel 21, in order to determine the driving or rotating direction of the hollow ratchet wheel 21. A spring 37 is received in the cavity 15 of the handle 11, and engaged with the projection 33, to bias and to force the teeth 36 at either of the ends of the pawl 31 to selectively engage with the teeth 24 of the hollow ratchet wheel 21, so as to control the driving direction of the ratchet wheel 21 by the handle 11.

The above described hollow ratchet wheel 21 of the ratchet device 20 and the pawl 31 of the driving direction control device 30 are typical and will not be described in further details.

The ratchet wrench 10 in accordance with the present invention further comprises one or more tool members 40 to be selectively and changeably attached to the hollow ratchet wheel 21 of the ratchet device 20, for being rotated or driven by the handle 11 via the hollow ratchet wheel 21.

As shown in FIGS. 2–6, each of the tool members 40 includes a body 41, and a stem 42 extended upwardly from the body 41 and having a non-circular cross section, for engaging into the space 23 of the hollow ratchet wheel 21, and for being rotated in concert with the hollow ratchet wheel 21, and thus for being rotated or driven by the handle 11 via the hollow ratchet wheel 21.

It is preferable that the body 41 of the tool members 40 includes an outer diameter greater than that of the stem 42 (FIGS. 2–5), or equals to that of the stem 42 (FIGS. 6, 7), for forming a peripheral shoulder 49 between the body 41 and the stem 42, and for engaging with the lower portion 26 of the hollow ratchet wheel 21 (FIGS. 3, 4), so as to anchor or secure or attach the body 41 of the tool members 40 to the hollow ratchet wheel 21, and thus for allowing the tool members 40 to be rotated or driven by the handle 11 via the hollow ratchet wheel 21.

Each of the tool members 40 further includes a peripheral groove 43 formed in the upper peripheral portion of the stem 42, for receiving a soft or resilient ring member 44 which is made of rubber or other synthetic materials.

The soft or resilient rubber ring member 44 may be deformed or squeezed, and may thus be easily engaged through the space 23 of the hollow ratchet wheel 21, and may be quickly engaged with or seated on the inclined surface 27 that is formed or provided in the upper portion 25 of the hollow ratchet wheel 21 (FIGS. 3, 4), such that the tool members 40 may be easily and quickly attached and anchored to the hollow ratchet wheel 21 with the ring member 44.

Each of the tool members 40 includes an engaging hole 45 formed in the body 41 (FIGS. 2, 3), for receiving lock nuts 50 (FIG. 3), driving members or screw driver bits 52 (FIG. 4), or the like, and includes a passage 46 formed in the stem 42 (FIG. 3), and communicating with the engaging hole 45 of the body 41, for receiving bolts 51 (FIG. 3), or the like, and thus for allowing various tool elements 50, 51, 52 to be attached to and to be rotated or driven by the tool members 40.

Figure 5:
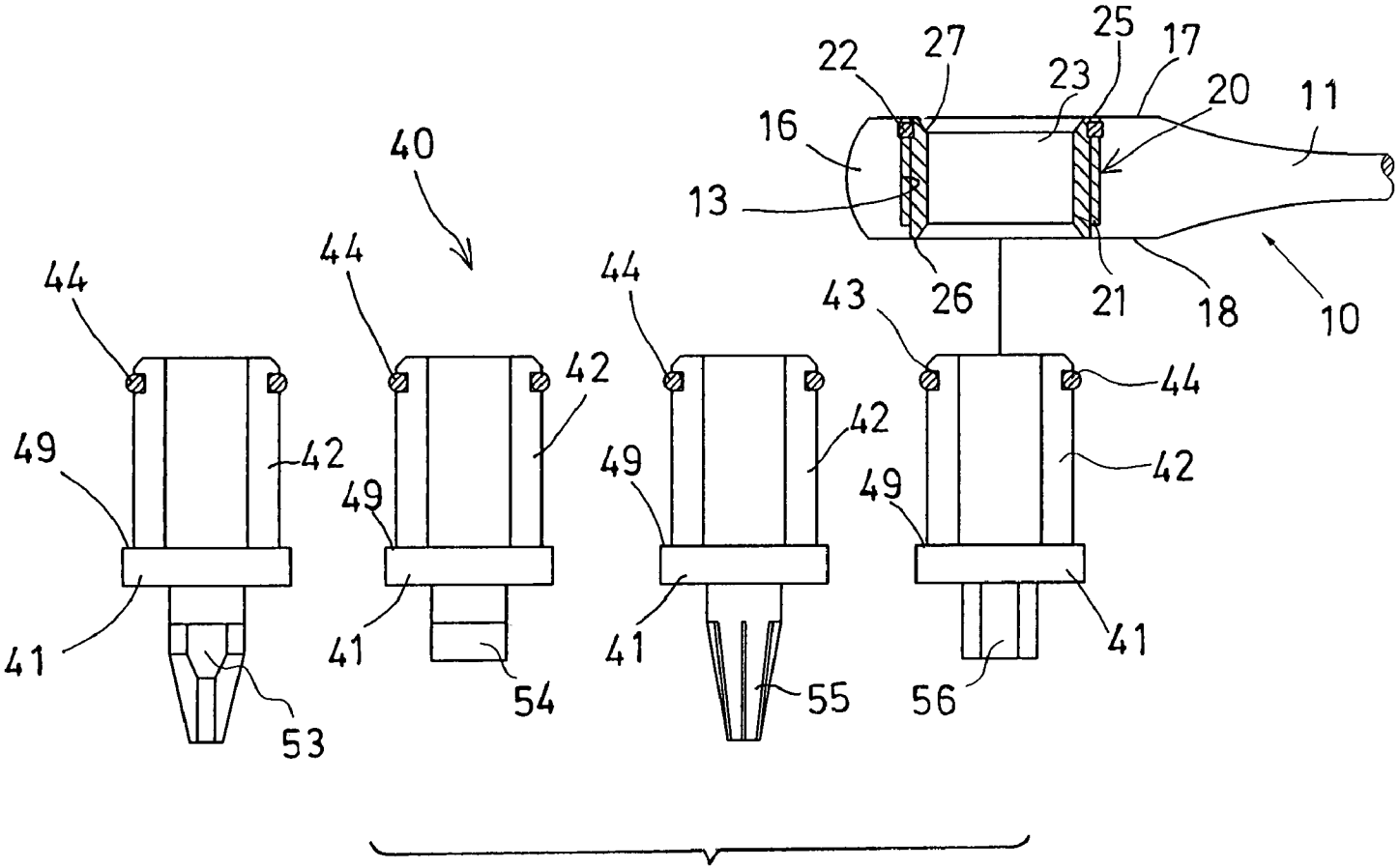
FIG. 5 is a plan schematic view illustrating selectively attachments of various tool members to the ratchet wrench.
Figure 6:
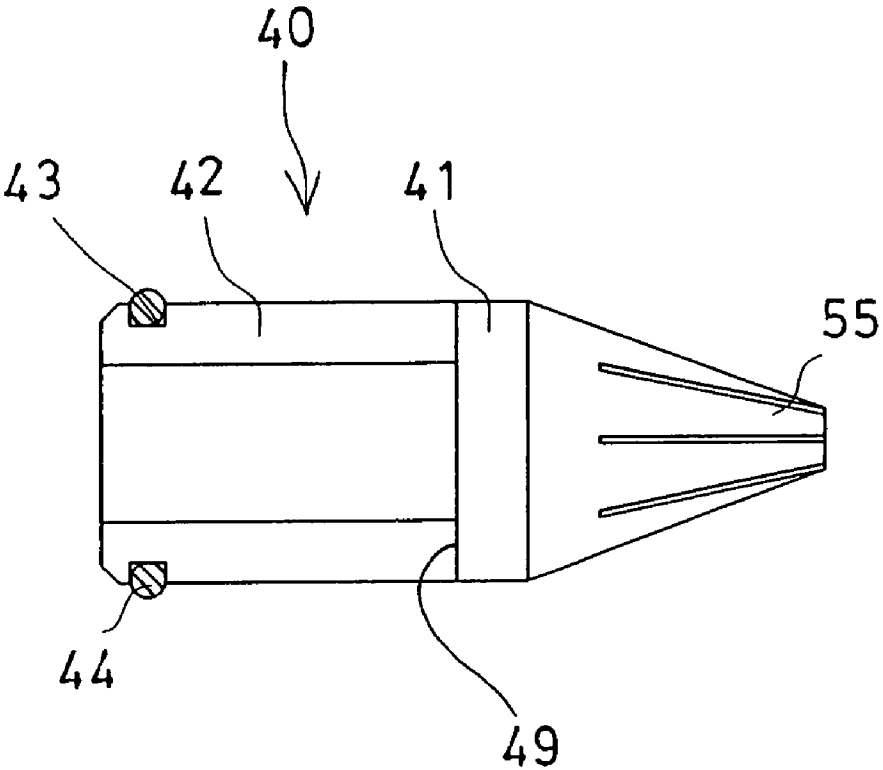
FIG. 6 is a plan schematic view illustrating one of the tool members for the ratchet wrench.
Figure 7:
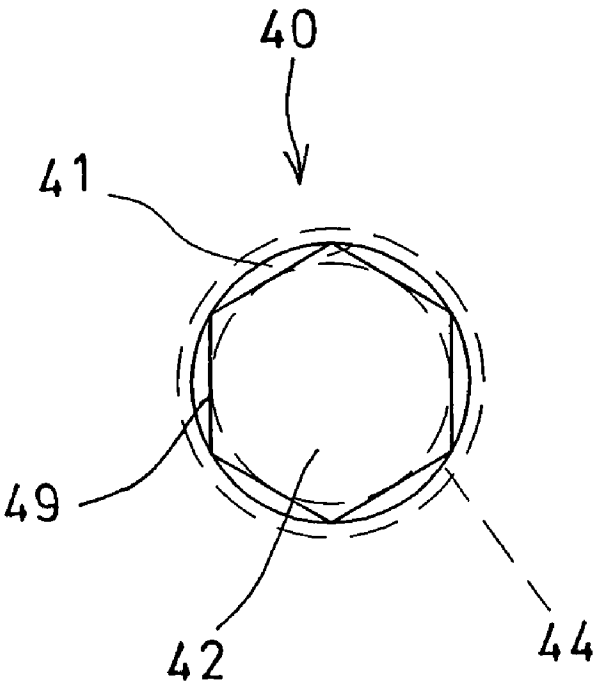
FIG. 7 is an end view of the tool members as shown in FIG. 6, for the ratchet wrench.

As shown in FIGS. 5 and 6, the other tool members 40 may each include a driving shank 53, 54, 55, 56 extended from and formed integral with the body 41, to engage with and to drive fasteners (not shown). For example, the driving shank 53–56 may include a Phillips head 53, a flat head 54 having a rectangular cross section, a star-drive type head 55 (FIGS. 5, 6), a hexagonal head 56, or the like.

Figure 4:
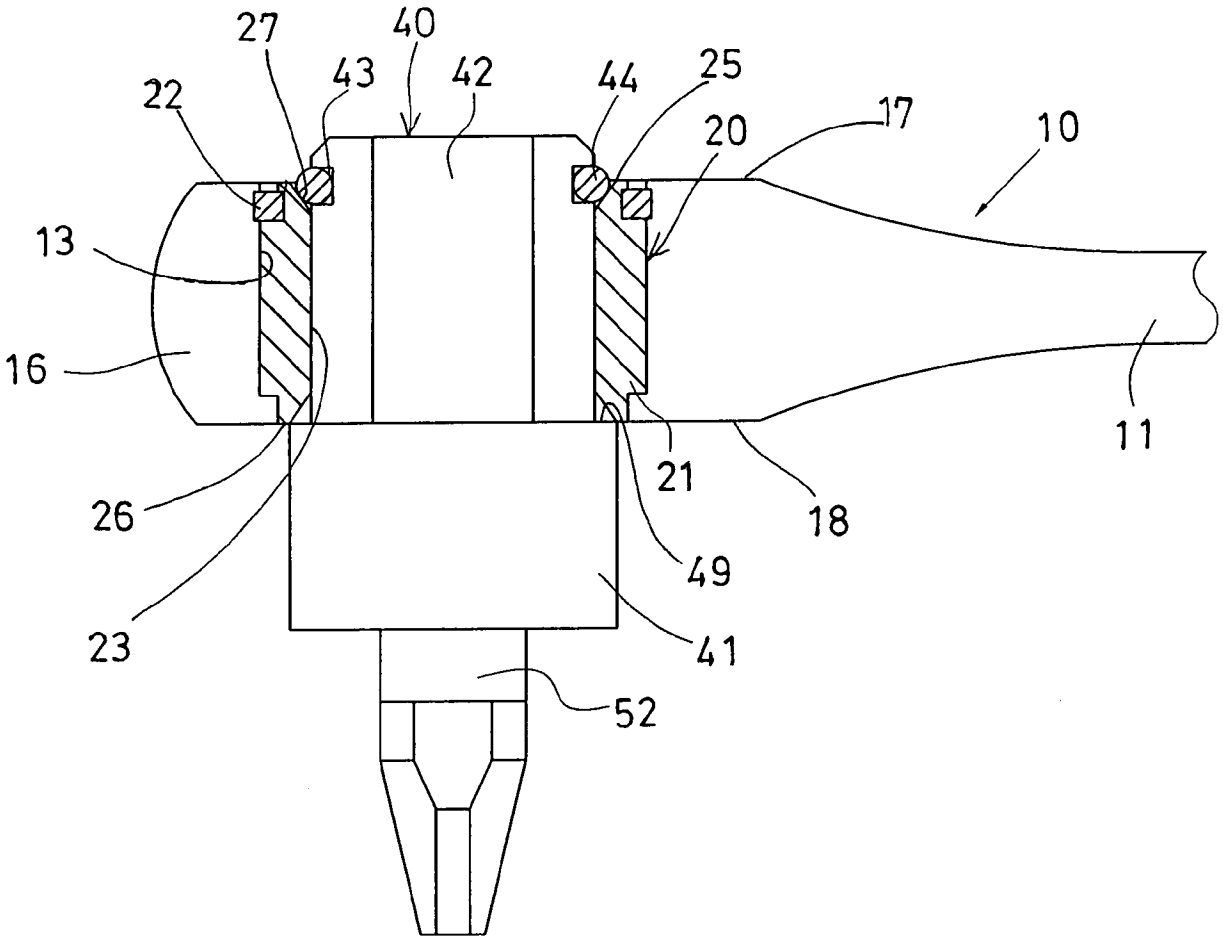
FIG. 4 is a partial cross sectional view similar to FIG. 3, illustrating the other application of the ratchet wrench.

In operation, as shown in FIGS. 3–5, the stems 42 of the tool members 40 may be easily and quickly engaged into or through the space 23 of the hollow ratchet wheel 21, and the body 41 of the tool members 40 may be engaged with the lower portion 26 of the hollow ratchet wheel 21 (FIGS. 3, 4), so as to anchor the body 41 of the tool members 40 to the hollow ratchet wheel 21.

In addition, the resilient rubber ring member 44 may be deformed or squeezed, and may be easily and quickly engaged through the space 23 of the hollow ratchet wheel 21, and may be quickly engaged with or seated on the inclined surface 27 of the upper portion 25 of the hollow ratchet wheel 21 (FIGS. 3, 4), such that the tool members 40 may be easily and quickly attached and anchored to the hollow ratchet wheel 21 with the ring member 44, and such that the tool members 40 may be effectively or quickly rotated or driven by the handle 11 via the hollow ratchet wheel 21.

It is to be noted that the body 41 of the tool members 40 may be engaged with the lower portion 26 of the hollow ratchet wheel 21, and the resilient rubber ring member 44 may be engaged with the upper portion 25 of the hollow ratchet wheel 21, such that the tool members 40 may be quickly and stably anchored or attached or retained to the hollow ratchet wheel 21, and may be prevented from being disengaged from the hollow ratchet wheel 21.

The tool members 40 as shown in FIGS. 2–7 may thus be selectively and changeably attached to the hollow ratchet wheel 21 of the ratchet device 20, for being rotated or driven by the handle 11 via the hollow ratchet wheel 21. In addition, the tool elements 50, 51, 52 may be selectively attached to and to be rotated or driven by the tool members 40; or the tool members 40 may each include a driving shank 53, 54, 55, 56 extended from and formed integral with the body 41, to engage with and to drive fasteners (not shown).

Accordingly, the ratchet wrench in accordance with the present invention includes an easily anchoring structure or device, or having a simplified tool adapter, for easily attaching various tool members to the ratchet wrenches and for allowing the tool members to be effectively rotated or driven by the ratchet wrenches.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet wrench comprising:

a handle including a head having a compartment formed therein, and including an opening formed therein, a hollow ratchet wheel rotatably received in said compartment of said head, said hollow ratchet wheel including an upper portion and a lower portion, and including a space formed therein, and including a plurality of teeth provided on outer peripheral portion thereof, and including an inclined surface formed in said upper portion thereof, a driving direction control device received in said handle, and engaged with said hollow ratchet wheel, to control driving direction of said hollow ratchet wheel, said driving direction control device including a pawl pivotally received in said opening of said handle and having two end teeth, said pawl being pivotally attached to said handle with a rod, to allow said pawl to be rotated relative to said handle about said rod, means for actuating either of said end teeth of said pawl to engage with said teeth of said hollow ratchet wheel, to control driving direction of said hollow ratchet wheel, a tool member including a body engageable with said lower portion of said hollow ratchet wheel and including an engaging hole formed therein for fastener receiving purposes, and including a stem extended upwardly from said body and engageable through said space of said hollow ratchet wheel and rotated in concert with said hollow ratchet wheel, and including a peripheral shoulder formed between said stem and said body, and said stem including a peripheral groove formed therein, and including a passage formed therein and communicating with said engaging hole of said body, and a resilient and deformable ring member attached onto said stem and engaged in said peripheral groove of said stem, and engageable through said space of said hollow ratchet wheel, and engageable with said upper portion of said hollow ratchet wheel and selectively seated on said inclined surface of said hollow ratchet wheel, to quickly attach and anchor said tool member to said hollow ratchet wheel with said ring member.

2. The ratchet wrench as claimed in claim 1 further comprising at least one second tool member including a body engageable with said lower portion of said hollow ratchet wheel, and including a stem extended upwardly from said body and engageable through said space of said hollow ratchet wheel and rotated in concert with said hollow ratchet wheel, and a resilient and deformable ring member attached onto said stem, and engageable through said space of said hollow ratchet wheel, and engageable with said upper portion of said hollow ratchet wheel, to quickly attach and anchor said tool member to said hollow ratchet wheel with said ring member, and said at least one second tool member including a driving shank extended from said body and selected from a Phillips head, a flat head, a star-drive head, and a hexagonal head.

* * * * *